US008272492B1

(12) United States Patent
Chang

(10) Patent No.: US 8,272,492 B1
(45) Date of Patent: Sep. 25, 2012

(54) WALL-MOUNTABLE VENDING MACHINE SUPPORT BRACKET AND ASSEMBLY

(76) Inventor: Kil Jae Chang, Anyang (KR)

( * ) Notice: Subject to any disclaimer, the term of this patent is extended or adjusted under 35 U.S.C. 154(b) by 1232 days.

(21) Appl. No.: 12/006,890

(22) Filed: Jan. 7, 2008

Related U.S. Application Data

(62) Division of application No. 11/438,019, filed on May 19, 2006, now abandoned.

(51) Int. Cl.
*G07F 9/10* (2006.01)

(52) U.S. Cl. ..... 194/350

(58) Field of Classification Search ..... 194/350; 221/154, 282, 283, 285, 286; 222/180; 248/671, 248/536, 124.1, 218.4, 231.91, 310; 52/35, 52/36.5; 312/245, 351.1
See application file for complete search history.

(56) References Cited

U.S. PATENT DOCUMENTS

| | | | | | |
|---|---|---|---|---|---|
| 1,079,192 | A | | 11/1913 | Sowden | |
| 1,262,465 | A | * | 4/1918 | Dohrmann | 206/209.1 |
| 1,580,207 | A | * | 4/1926 | Kibbe | 248/552 |
| 1,683,722 | A | * | 9/1928 | Morin | 221/97 |
| 1,699,476 | A | | 1/1929 | Morin | |
| 1,709,239 | A | | 4/1929 | Van Wiebe | |
| 1,748,433 | A | | 2/1930 | Wetzell et al. | |
| 1,959,809 | A | | 5/1934 | Benjamin | |
| 2,199,313 | A | | 4/1940 | Traphan | |
| 2,315,811 | A | | 4/1943 | Niewoehner | |
| 2,887,351 | A | * | 5/1959 | Allender | 312/245 |
| 4,205,620 | A | * | 6/1980 | Keys | 116/308 |
| 5,131,519 | A | * | 7/1992 | Ra | 194/350 |
| 5,351,856 | A | * | 10/1994 | Laidlaw | 221/131 |
| 5,433,414 | A | | 7/1995 | Vieira | |
| 6,095,471 | A | | 8/2000 | Huang | |
| 6,863,198 | B1 | | 3/2005 | Darby | |
| 2006/0037837 | A1 | | 2/2006 | Schrumpf | |

* cited by examiner

*Primary Examiner* — Mark Beauchaine
(74) *Attorney, Agent, or Firm* — John R. Flanagan

(57) ABSTRACT

A wall-mountable support bracket for supporting a vending machine on a vertical wall includes a load-bearing main member and a top member coupled to the main member to be movable between engaged and disengaged positions relative to the top of the vending machine. The main member is in the form of a one-piece unitary metal plate bent into a substantially fixed angular shape in which the main member is capable of supporting the vending machine on the vertical wall. First apertures in a back portion of the main member receive first fasteners to fixedly attach the main member to the vertical wall. Second apertures in the back portion and a bottom portion of the main member and holes in a bottom and side of a base of the vending machine receive second fasteners to fixedly attached the vending machine to the main member.

5 Claims, 3 Drawing Sheets

WALL-MOUNTABLE VENDING MACHINE SUPPORT BRACKET AND ASSEMBLY

This application is a divisional application of U.S. application Ser. No. 11/438,019, filed May 19, 2006 now abandoned, and claims the benefit of its filing date under 35 U.S.C. 120.

BACKGROUND OF THE INVENTION

1. Field of the Invention

The present invention generally relates to vending machines and, more particularly, is concerned with a wall-mountable vending machine support bracket and assembly.

2. Description of the Prior Art

Coin-operated vending machines are typically supported on a counter or freestanding on a stand. However, various devices have been proposed heretofore in the prior art for mounting a vending machine in other ways. Some representative devices are those disclosed in U.S. Pat. No. 1,580,207 to Kibbe, U.S. Pat. Nos. 1,683,722 and 1,699,476 to Morin, U.S. Pat. No. 1,709,239 to Ver Wiebe, U.S. Pat. No. 1,748,433 to Wetzell et al., U.S. Pat. No. 1,959,809 to Benjamin, U.S. Pat. No. 2,199,213 to Traphan, and U.S. Pat. No. 2,315,811 to Niewoehner.

More specifically, the Kibbe patent discloses a support bracket for mounting a vending machine to a generally vertical wall. The support bracket has a base fastened by screws to the vertical wall and first and second bracket portions fixedly secured to and projecting forwardly of the base at locations intermediately between upper and lower ends of the base. The first bracket portion has a platform with upstanding lugs that fit into perforated ears on the vending machine. The second bracket portion is located below the first bracket portion and terminates in a downwardly extending end having a vertical open ended-slot snugly receiving an extension of the vending machine. Thus, the lugs of the first bracket portion prevent lateral motion of the vending machine. The slot of the second bracket portion receiving the notched extension of the vending machine prevents upward motion of the vending machine and the platform of the first bracket portion prevents downward motion of the vending machine. The support bracket also has top and bottom hasps hingedly secured to the base at locations spaced from but adjacent to opposite upper and lower ends thereof. The hasps are pivotable between retracted vertical positions and extended horizontal positions relative to a respective top cover and a bottom base of the vending machine and can be placed into interfitting relations with staples secured at upper and lower ends of a central rod of the vending machine and retained in such relations by padlocks so as to retain the vending machine in an upright position on the support bracket.

A major problem with the Kibbe support bracket is that it appears to have an overly awkward and complicated construction that requires an inordinate number of parts just to accomplish the relatively straightforward and simple task of mounting a vending machine on a vertical wall. Therefore, a need still exists for the provision of a support bracket which will overcome the problems associated with the Kibbe device by embodying a much simpler construction while still functioning reliably in mounting a vending machine to a vertical wall.

SUMMARY OF THE INVENTION

The present invention provides a wall-mountable vending machine support bracket and assembly which are designed to satisfy the aforementioned needs. The support bracket of the present invention is about as simple in construction and as few in parts as one could practically envision while still providing an effective device for bearing the weight of a vending machine as it reliably mounts it to a vertical wall.

Accordingly, the present invention is directed to a wall-mountable vending machine support bracket for supporting a vending machine on a vertical wall. The bracket comprises: (a) a load-bearing main member in the form of a one-piece unitary metal plate bent into a substantially fixed angular shape in which the main member is capable of supporting a vending machine on a vertical wall, the main member having a back portion, a bottom portion extending in a transverse relation to the back portion, a first plurality of apertures defined through the back portion, and a second plurality of apertures defined through the back and bottom portions; (b) a first plurality of fasteners insertable through the first plurality of apertures to fixedly attach the main member to the vertical wall; (c) a second plurality of fasteners insertable into the second plurality of apertures to fixedly attached the vending machine to the main member; and (d) a top member coupled to the main member so as to be movable between engaged and disengaged conditions relative to the vending machine without affecting the fixed attachment of the vending machine to the main member.

The present invention is also directed to a wall-mountable vending machine assembly which comprises: (a) a vending machine having a housing, a globe mounted on the housing and extending thereabove for holding multiple items, a coin-operated item dispensing mechanism mounted in the housing below the globe and being actuatable in response to deposit of at least one coin to transfer and dispense an item from the globe to an exterior location on the housing, a top cover removably mounted on an upper open end of the globe, an elongated assembly rod extending longitudinally and vertically through the housing between the top cover and a base of the housing where a lower end of the rod is secured to the housing base, and a key-actuated lock device releasably secured to an upper end of the rod and mateable with the top cover so as to retain the globe between the top cover and the housing, the base of the housing being provided with a plurality of holes in a bottom and a rear side of the base; and (b) wall-mountable support bracket including (i) a load-bearing main member in the form of a one-piece unitary metal plate bent into a substantially fixed angular shape in which the main member is capable of supporting the vending machine on a vertical wall, the main member having a back portion, a bottom portion extending in a transverse relation to the back portion, a first plurality of apertures defined through the back portion, and a second plurality of apertures defined through the back and bottom portions; (ii) a first plurality of fasteners insertable through the first plurality of apertures to fixedly attach the main member to the vertical wall; (iii) a second plurality of fasteners insertable into the second plurality of apertures and the plurality of holes to fixedly attach the vending machine at the base thereof upon the main member; and (iv) a top member coupled to the main member so as to be movable between engaged and disengaged conditions relative to the top cover, rod and key-actuated lock device of the vending machine without affecting the fixed attachment of the base of the housing of the vending machine to the main member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
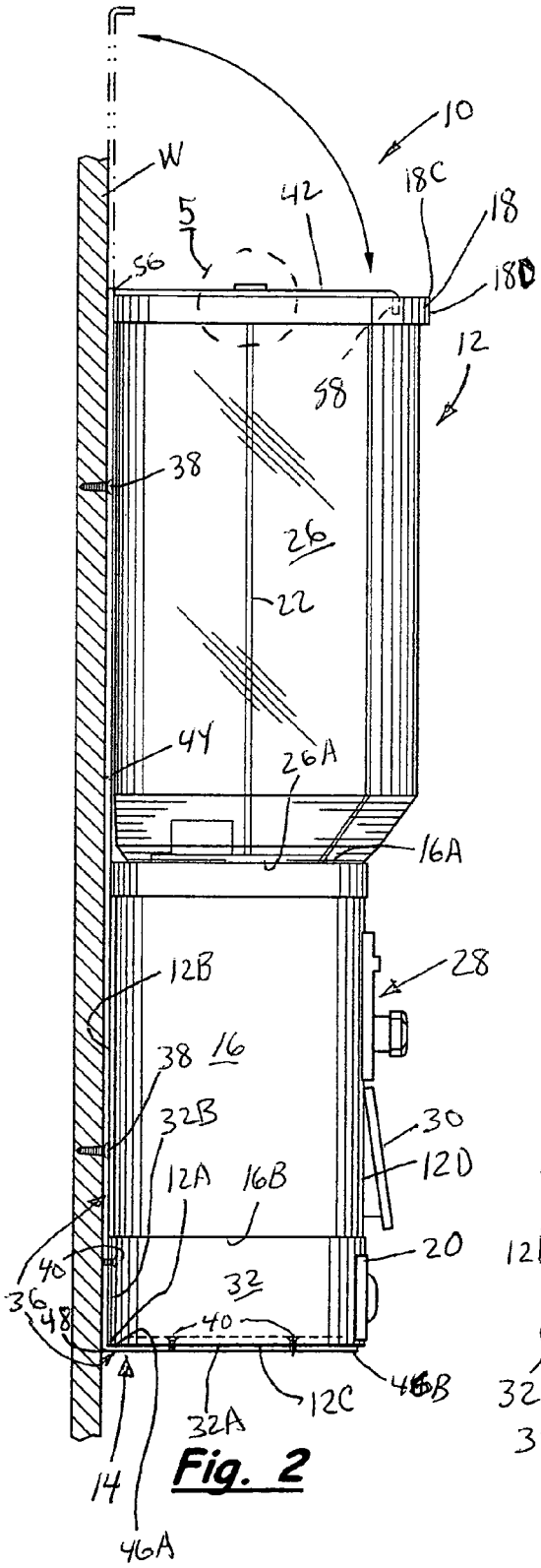
FIG. 2 is a side elevational view of the assembly as seen along line 2-2 of FIG. 1.
Figure 1:
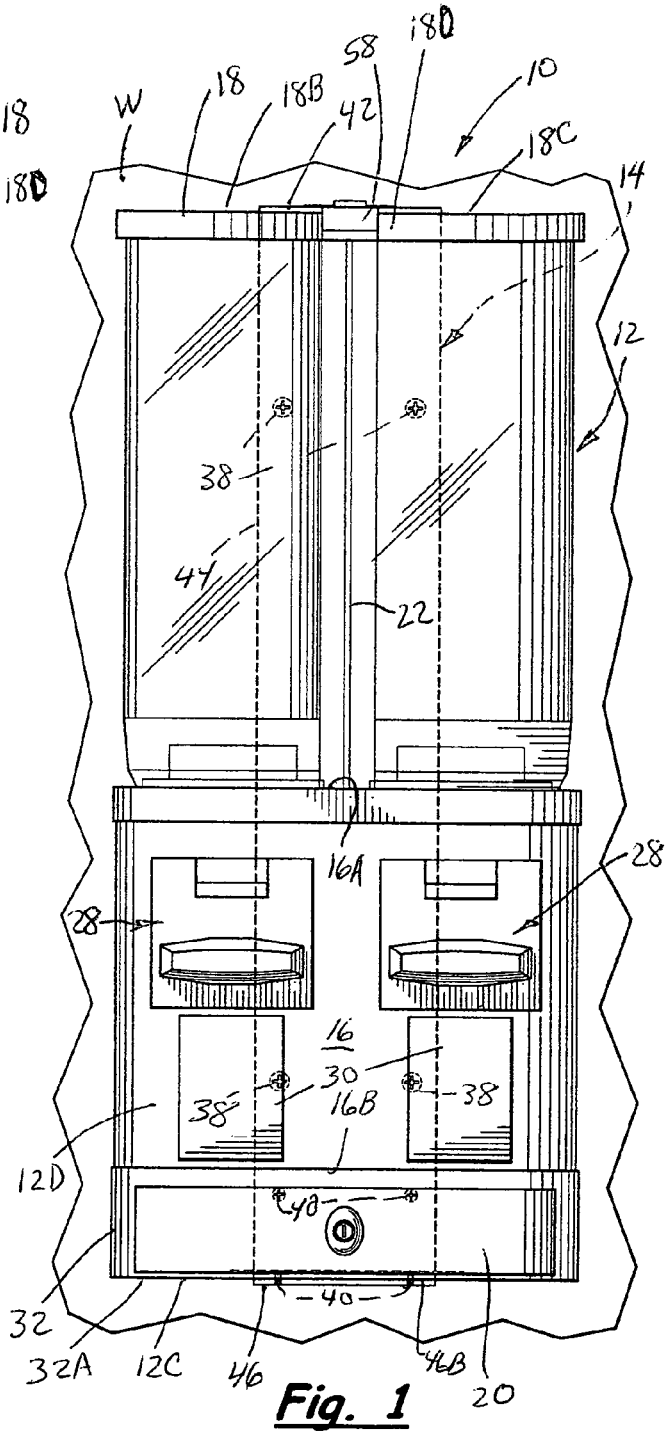
FIG. 1 is a front elevational view of a wall-mountable vending machine assembly of the present invention.
Figure 3:
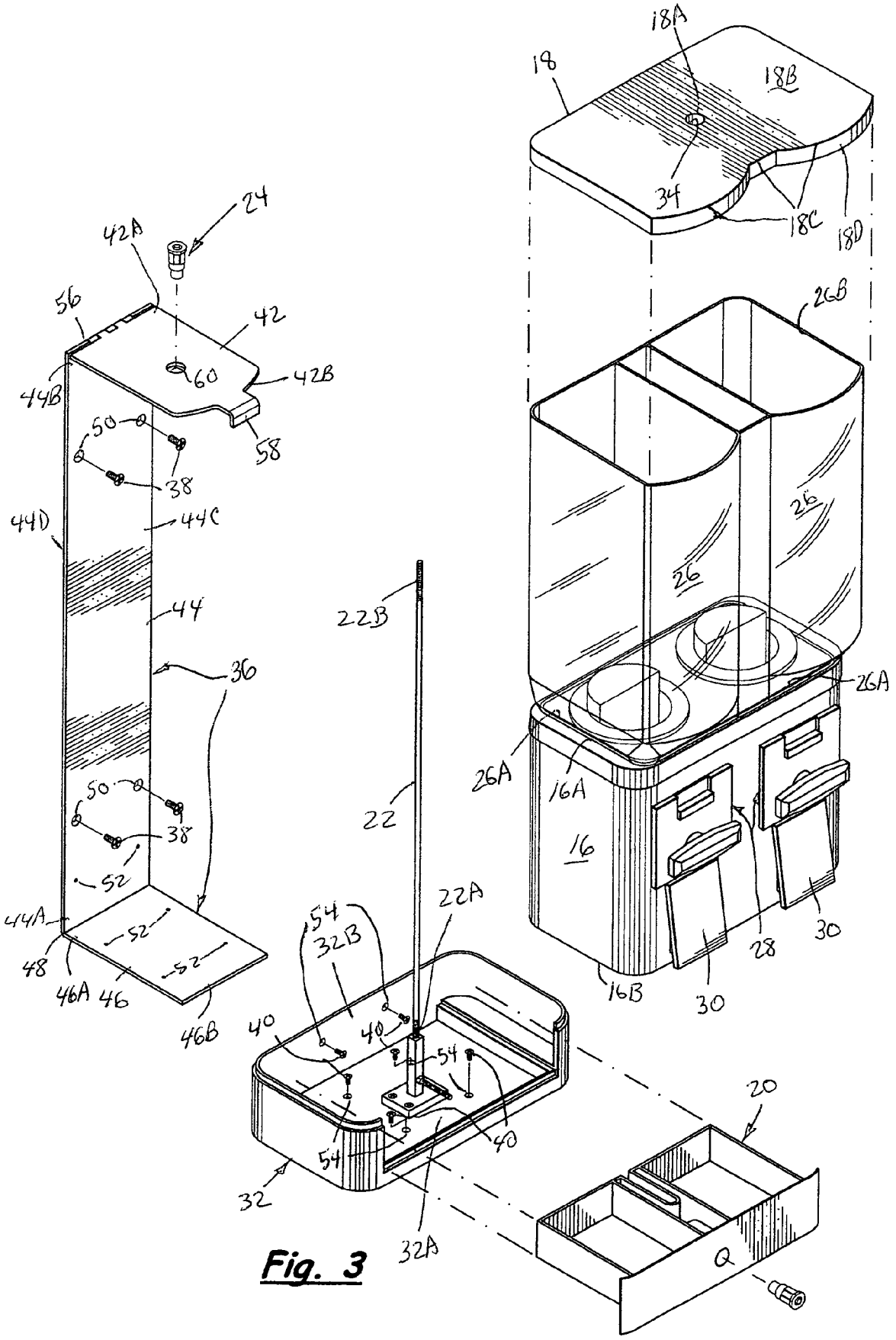
FIG. 3 is an exploded view of the vending machine assembly.
Figure 4:
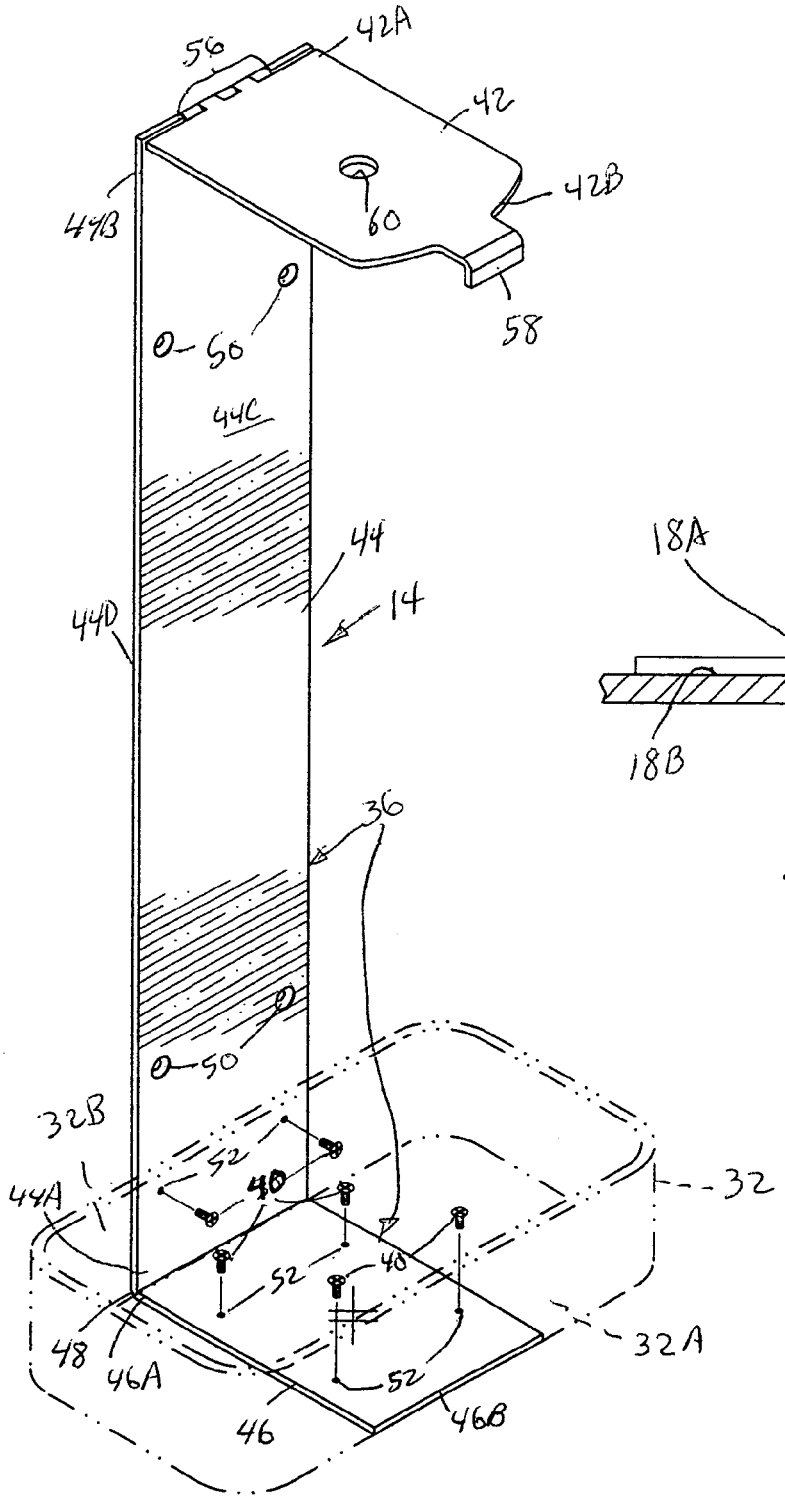
FIG. 4 is a perspective view of a support bracket of the assembly.

Referring to the drawings and particularly to FIGS. 1 to 3, there is illustrated a wall-mountable vending machine assembly, generally designated 10, of the present invention. Basically, the wall-mountable vending machine assembly 10 includes a vending machine, generally designated 12, and a support bracket, generally designated 14. In the embodiment of FIGS. 1 to 3, the vending machine 12 is a dual-head type vending machine which is provided with two sets of some of the components of two single-head type vending machines being positioned side-by-side in a single housing 16, with a single top cover 18, a single coin collection box 20, a single elongated assembly rod 22 located between the two sets of components, and a single key-actuated lock device 24 seated on the top cover 18 and secured to the assembly rod 22. It should be understood that, alternatively, a single-head type vending machine or a vending machine of another suitable construction could be employed in the assembly 10 of the present invention.

More particularly, in addition to the housing 16, top cover 18, coin collection box 20, assembly rod 22 and lock device 24, the vending machine 12 has two globes 26 mounted side-by-side on an open top end 16A of the housing 16 and extending thereabove for holding multiple items therein, two coin-operated dispensing mechanisms 28 mounted side-by-side in the housing 16 below and enclosing respective lower open ends 26A of the respective globes 26 and being actuatable in response to deposit of respective coins to transfer and dispense items from the corresponding globes 26 to two exterior locations 30 on the housing 16. The coin collection box 20 is adapted to receive the coins from both dispensing mechanisms 28. The top cover 18 is removably mounted on upper open ends 26B of the respective globes 26. The assembly rod 22 extends longitudinally and vertically through the housing 16 between the top cover 18 and a bottom portion or base 32 of the housing 16 where a lower end 22A of the assembly rod 22 is secured to the housing base 32. The key-actuated lock device 24 is seatable on a circular rim 18A of the top cover 18 and extendable into a hole 34 defined by the rim 18A so as to be releasably securable to an upper end 22B of the assembly rod 22 and thereby clamp and retain the globes 26 between the top cover 18 and the open top end 16A of the housing 16.

Referring to FIGS. 1 to 4, the wall-mountable support bracket 14 includes a load-bearing main member 36, a first plurality of fasteners 38, a second plurality of fasteners 40, and a top member 42. The load-bearing main member 36 has a back portion 44, a bottom portion 46, and a corner portion 48 disposed between and merging into the back and bottom portions 44, 46. The back portion 44 at a lower end 44A thereof and the bottom portion 46 at a rearward end 46A thereof are rigidly and integrally interconnected by the corner portion 48. Further, the back, bottom and corner portions 44, 46, 48 of the main member 36 are in the form of a one-piece unitary plate preferably made of a suitable metal, such as a steel, and bent into a substantially fixed angular shape in which the main member 36 is capable of supporting the vending machine 12 adjacent to and against the back portion 44, upon the bottom portion 46, and seated at a lower rear edge 12A of the vending machine 12 against the corner portion 48 of the main member 36 wherein such relationship the main member 36 is capable of supporting the vending machine 12. The bottom portion 46 extends in a transverse, substantially right-angular, relation to the back portion 44 such that with the back portion 44 disposed flush against the vertical wall W, the bottom portion 46 extends approximately ninety degrees from the vertical wall W.

The back portion 44 of the main member 36 preferably, but not necessarily, is of a generally straight planar flat configuration allowing its positioning co-extensively along a rear side 12B of the vending machine 12 formed by its housing 16, base 32, top cover 18 and globes 26. The back portion 44 is of sufficient length relative to the rear side of the vending machine 12 for opposite lower and upper ends 44A, 44B of the back portion 44 to extend short distances above the top cover 18 and below the lower rear edge 12A the vending machine 12. The back and bottom portions 44, 46 of the metal plate comprising the main member 36 preferably are substantially uniform in thickness and width. The corner portion 48 is located an angular bend in the metal plate. Preferably, the back portion 44 has a substantially greater length than the bottom portion 46.

The back portion 44 has a first plurality of like holes or apertures 50 defined therethrough between front and rear surfaces 44C, 44D of the back portion 44. In particular, two pairs of the like apertures 50 are provided through the back portion 44 respectively adjacent to but spaced from lower and upper ends 44A, 44B thereof. As seen in FIGS. 2 and 3, the first plurality of like fasteners 38 insert, in a direction going from the front surface 44C toward the rear surface 44D of the back portion 44, through the first plurality of apertures 50 in the back portion 44 in order to fixedly attach the first plurality of fasteners 38 to the wall W and thereby firmly hold the back portion 44 of the main member 36 at its rear surface 44D flush against the flat surface of the vertical wall W so that the front surface 44C of the back portion 44 is disposed adjacent to and contiguous with the rear side 12B of the vending machine 12 with the latter placed in an upright operating orientation.

The bottom portion 46 of the main member 36 preferably, but not necessarily, is also of generally straight planar flat configuration allowing its positioning in an underlying relation along a bottom side 12C of the vending machine 12 formed by a bottom 32A of its base 32. The bottom portion 46 extends forwardly from the corner portion 48 to a forward end 46B located a short distance rearwardly of a front side 12D of the vending machine 12 when the rear side 12B of the vending machine 12 is disposed adjacent to and contiguous with the front surface 44C of the back portion 44 of the main member 36, as seen in FIG. 2.

The back and bottom portions 44, 46 have a second plurality of like holes or apertures 52 defined therethrough. In particular, one pair of the like apertures 52 is formed in the back portion 44 between the lower pair of the first apertures 50 and the corner portion 48, whereas two other pairs of the like apertures 52 are formed in the bottom portion 46 in spaced relation to one another and at the opposite ends of the bottom portion 46. Preferably, as can be readily seen in FIGS. 2 and 3, the like apertures 50 of the first plurality are of a size (diameter) larger than the like apertures 52 of the second plurality, and similarly, the like fasteners 38 of the first plurality are of a size (diameter and length) larger than the like fasteners 40 of the second plurality. As seen in FIGS. 2 and 3, the second plurality of fasteners 40 insert into the second plurality of apertures 52 after their insertion from inside the housing 16 through aligned holes 54 defined through the bottom 32A and a rear side 32B of the base 32 of the housing 16 of the vending machine 12 which are portions of the base 32 disposed in a transverse relation to one another. In such manner, preferably, the vending machine 12 at such portions of its base 32 disposed in transverse relation to one another is held against the back and bottom portions 44, 46 of the main member 36 by the second fasteners 40 being fixedly attached upon the main member 36 of the support bracket 14 after the support bracket 14 is fixedly attached to the wall W solely by carrying out the steps of, first, fixedly attaching the back portion 44 of the main member 36 of the support bracket 14 to the vertical wall W and, then, fixedly attaching the base 32 of the vending machine 12 to the back and bottom portions 44, 46 of the main member 36 of the support bracket 14. The other components of the vending machine 12 can be assembled onto the base 32 in a known manner after the base 32 is attached on the main member 36 of the support bracket 14 and must be disassembled from the base 32 before the base 32 can be disassembled from the support bracket 14. The support bracket 14 by having the above-described rigid construction is capable of supporting the load of the vending machine 12 on the vertical wall W. It should be understood that other modes of fixedly attaching the vending machine 12 and support bracket 14 together and the support bracket 14 to the vertical wall W can be employed.

Figure 5:
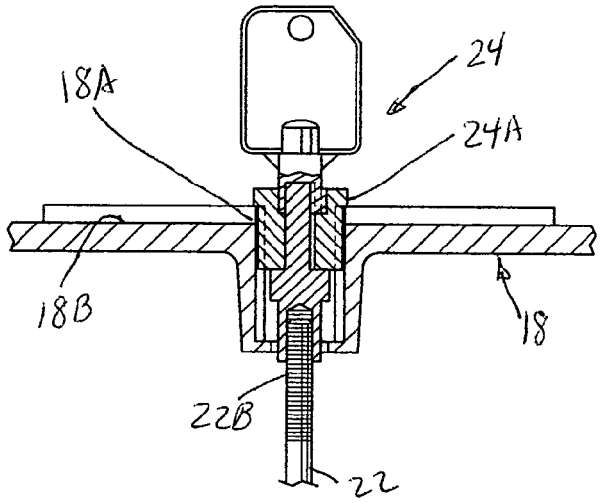
FIG. 5 is an enlarged fragmentary view of a portion of the assembly enclosed by a dashed circle 5 in FIG. 2, showing the locked securement of a pivotal top member of the support bracket on a top cover of the vending machine of the assembly by a key-operated lock device.

Referring now to FIGS. 2-5, the top member 42 is shown coupled, preferably pivotally, at a hinge 56 at its rear end 42A to the upper end 44B of the back portion 44 of the main member 36. The top member 42 is manually pivotally movable, as seen in FIG. 2, relative to the main member 36 between engaged and disengaged conditions relative to the top cover 18, assembly rod 22 and key-actuated lock device 24 of the vending machine 12 without affecting the fixed attachment of the base 32 of the vending machine 12 upon the main member 36. The top member 42 preferably, but not necessarily, is of a straight planar flat configuration. At its raised disengaged position or condition, as seen in broken line form in FIG. 2, the top member 42 is pivotally displaced toward the wall W where it is offset from the top cover 18 and is generally aligned with and forms a vertical extension of the back portion 44 of the main member 36 of the support bracket 14 which permits removable and replacement of the top cover 18 from and to the globes 26 of the vending machine 12. At its lowered engaged position or condition, as seen in solid line form in FIG. 2, the top member 42 extends in an overlying relation along a top side 18B of the top cover 18 of the vending machine 12 and in an aligned relation with the hole 34 in the top cover 18 that receives the lock device 24. The top member 42 thus seats on the top cover 18 and extends forwardly of the back portion 44 of the main member 36 in a generally transverse relationship thereto to a forward end 42B located beyond a front edge 18C of the top cover 18 of the vending machine 12 such that at the forward end 42B of the top member 42 a downwardly turned lip 58 is defined which extends for a short distance along the front side 18D of the top cover 18. The top member 42 has an opening 60 defined therethrough, about midway between its opposite ends 42A, 42B for receiving the lock device 24 when the top member 42 is at its lowered operative or engaged position. By operating the lock device 24 in a well-known manner it can be threaded onto the upper end 22B of the assembly rod 22 and clamp and secure the top member 42 between an upper rim 24A of the lock device 24 and the top cover 18 of the vending machine 12, as shown in FIG. 5, concurrently as the lock device 24 is secured to the upper end 22B of the rod 22 and mated with the top cover 18 to also clamp the globes 26 and housing 16 between the top cover 18 and the base 32 and thereby prevent removal of the top cover 18 from the globes 26 of the vending machine 12 and access to the second plurality of fasteners 40.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A wall-mounted vending machine assembly, comprising:

(a) a vending machine having (i) a housing with a base removably mounted to said housing, (ii) a globe mounted on said housing and extending thereabove for holding multiple items, (iii) a coin-operated item dispensing mechanism mounted in said housing below said globe and being actuatable in response to deposit of at least one coin to transfer and dispense an item from said globe to an exterior location on said housing, (iv) a top cover removably mounted on an upper end of said globe, (v) an elongated assembly rod extending longitudinally and vertically through said housing between said top cover and said base of said housing where a lower end of the rod is secured to said housing base, and (vi) a key-actuated lock device releasably secured to an upper end of said rod and mated with said top cover so as to retain said globe between said top cover and said housing, said base of said housing being provided with a plurality of holes in a bottom and rear side of said base being disposed in a transverse relation to one another; and (b) a wall-mounted support bracket including (i) a load-bearing main member in the form of a one-piece unitary metal plate bent into a substantially fixed angular shape in which said main member is capable of supporting a vending machine on a vertical wall, said main member having a back portion, a bottom portion extending in a transverse relation to said back portion, a first plurality of apertures defined in said back portion, and a second plurality of apertures defined in said back and bottom portions;

(ii) a first plurality of fasteners inserted through said first plurality of apertures in said back portion of said main member thereby fixedly attaching said back portion of said main member and said first plurality of fasteners to the vertical wall and thereby firmly holding said back portion of said main member against the wall;

(iii) a second plurality of fasteners inserted from inside of said base of said housing into said holes defined in said transversely-disposed bottom and rear side of said base of said housing of said vending machine and therefrom fixedly inserted into said second plurality of apertures in said back and bottom portions of said main member of said support bracket thereby fixedly attaching said transversely-disposed bottom and rear sides of said base of said vending machine and said second plurality of fasteners to said back and bottom portions of said main member of said support bracket thereby holding and retaining said base of said vending machine against said back portion and upon said bottom portion of said main member such that said base remains fixedly attached to said support bracket even after said vending machine is taken apart starting with removal of said key-actuated lock device from said top cover and rod, next removal of said top cover and globe from said housing, and, last, removal of said housing and rod from said base, all without affecting the retention of said base of said vending machine fixedly attached against said back portion and upon said bottom portion of said main member; and (iv) a top member coupled to said main member so as to be movable between engaged and disengaged conditions relative to said top cover, rod and key-actuated lock device of said vending machine without affecting the retention of said base of said housing of said the vending machine fixedly attached against said back portion and upon said bottom portion of said main member.

2. The assembly of claim 1 wherein said back portion of said main member is of generally straight planar flat configuration allowing its positioning co-extensively along a rear side of said vending machine.

3. The assembly of claim 1 wherein said bottom portion of said main member is of generally straight planar flat configuration allowing its positioning in an underlying relation along a bottom of said base of said vending machine.

4. The assembly of claim 1 wherein said back and bottom portions of said main member are substantially uniform in thickness and width.

5. The assembly of claim 1 wherein said back and bottom portions of said main member are rigidly interconnected by a corner portion located at an angular bend in said metal plate such that said back and bottom portions extend from said corner portion in a substantially right angular relationship to one another with said back portion having a substantially greater length than said bottom portion.

* * * * *